United States Patent [19]

Niida

[11] 4,242,880

[45] Jan. 6, 1981

[54] REFRIGERATING APPARATUS

[75] Inventor: Hideo Niida, Ibaraki, Japan

[73] Assignee: Tokyo Shibaura Electric Co., Ltd., Kawasaki, Japan

[21] Appl. No.: 847,435

[22] Filed: Nov. 1, 1977

[51] Int. Cl.[3] ..... F25B 39/02

[52] U.S. Cl. ..... 62/200; 62/525

[58] Field of Search ..... 62/199, 200, 205, 525

[56] References Cited

U.S. PATENT DOCUMENTS

| | | | |
|---|---|---|---|
| 2,106,591 | 1/1938 | Briggeman et al. | 62/200 X |
| 2,667,757 | 2/1954 | Shoemaker | 62/526 X |
| 2,719,407 | 10/1955 | Zearfoss, Jr. | 62/525 X |

FOREIGN PATENT DOCUMENTS

| | | |
|---|---|---|
| 47-26435 | 8/1972 | Japan . |
| 48-901 | 1/1973 | Japan . |
| 49-18274 | 5/1974 | Japan . |

*Primary Examiner*—William E. Wayner

*Attorney, Agent, or Firm*—Oblon, Fisher, Spivak, McClelland & Maier

[57] ABSTRACT

A refrigerating apparatus having two evaporators which are mounted respectively in the refrigeratory food compartment and the frozen food compartment, and wherein the refrigerant gas flow in the evaporator of the refrigeratory food compartment is controlled by both temperatures of the refrigeratory food compartment and the frozen food compartment.

4 Claims, 4 Drawing Figures

REFRIGERATING APPARATUS

BACKGROUND OF THE INVENTION

1. Field of the Invention

This invention relates to an improved refrigerating apparatus which includes two compartments and more particularly to such an apparatus wherein each compartment has evaporation therein.

2. Description of the Prior Art

Generally, the prior art refrigerating apparatus such as the two-compartment type refrigerator, includes two evaporators, each evaporator mounted in the frozen food compartment and the refrigerated food compartment, and the refrigerant gas flow is automatically controlled by the temperature of each compartment as disclosed in Japanese Patent Publication No. 48-901 (Tokunaga et al) and Japanese Utility Model Publications No. 47-26435 (Ushida et al) and No. 49-18274 (Kondoh).

However, in Ushida et al, the refrigerant gas flow of the first evaporator is controlled by an electromagnetic valve connected between a first capillary tube and the first evaporator. As a result, the valve frequently frosts due to refrigerant evaporation occurring between the first capillary tube and the first evaporator, and the solenoid coil of the valve locks, thus causing electrical accidents.

Both Tokunaga et al and Kondoh includes three capillary tubes and an electromagnetic valve, and the valve is connected between the condenser and the one capillary tube. But these references are undesirable, because, it is necessary that each capillary tube take into account the conduit resistance for setting. As a result, one compartment is not cool for the refrigerant gas so as to not flow to the second evaporator when the valve is opened.

SUMMARY OF THE INVENTION

Accordingly, it is an object of the present invention to provide a new and improved refrigerating apparatus.

It is another object of the present invention to provide a new and improved refrigerating apparatus which will not cool one compartment only.

Still another object of the present invention is to provide a new and improved refrigerating apparatus in which the refrigerant gas flow is controlled independently of each compartment.

A still further object of the present invention is to provide a new and improved refrigerating apparatus in which flowing refrigerant gas is controlled by temperature of each compartment.

A further object of the present invention is to provide a new and improved refrigerating apparatus in which flowing refrigerant gas is controlled by an electromagnetic valve.

Yet another object of the present invention is to provide a new and improved refrigerating apparatus which includes three capillary tubes.

Briefly, in accordance with the present invention, these and other objects are obtained by providing two compartments for cooling wherein an evaporator is mounted in the each compartment.

In the refrigerant circuit of the refrigerating device, three capillary tubes and the valve are combined.

BRIEF DESCRIPTION OF THE DRAWINGS

Various other objects, features and attendant advantages of the invention will be more fully appreciated as the same becomes better understood by reference to the following detailed description when considered in connection with the accompanying parts and in which:

FIGS. 5A and 5B illustrate the operation of the valve of the present invention.

DESCRIPTION OF THE PREFERRED EMBODIMENT

Figure 1:
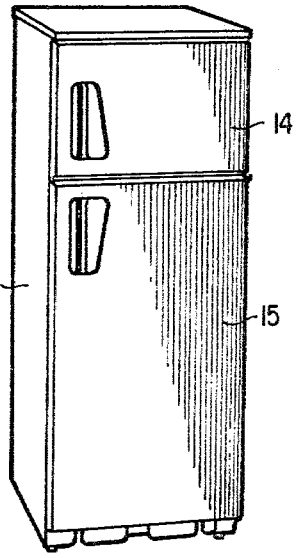
FIG. 1 is a perspective view of refrigerating apparatus according to the present invention.
Figure 3:
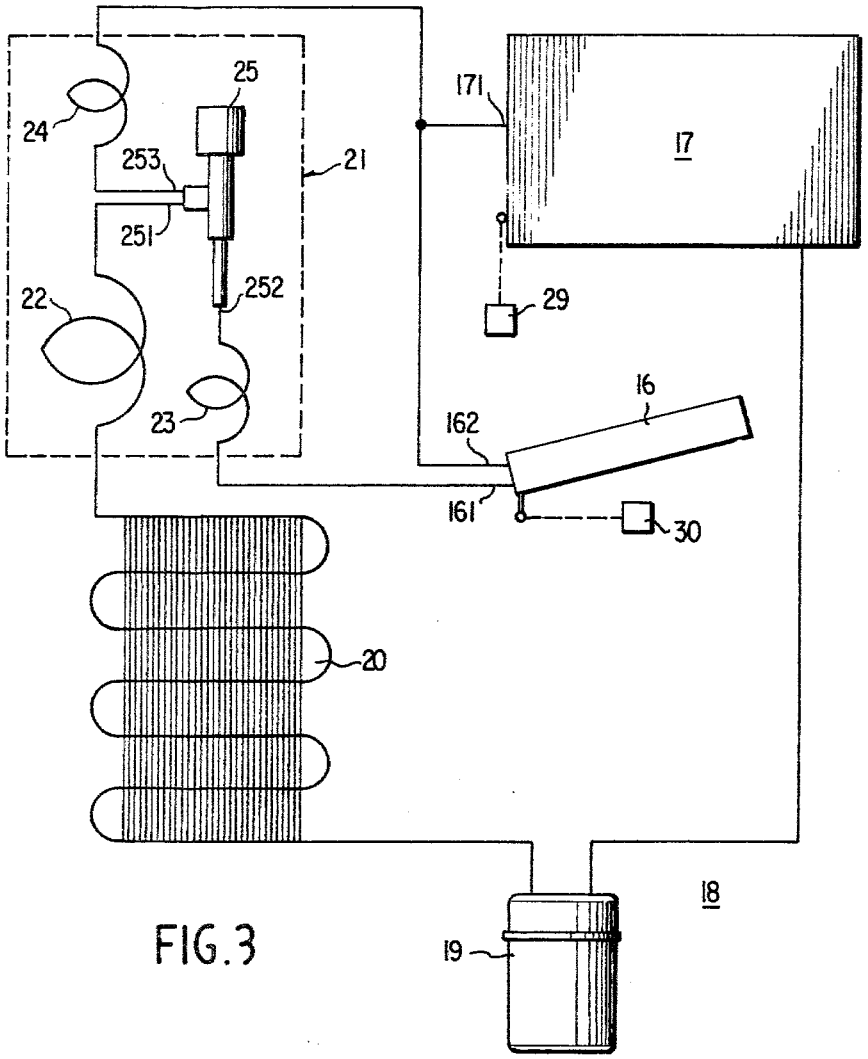
FIG. 3 is a diagram of refrigerant cycle according to the present invention.
Figure 2:
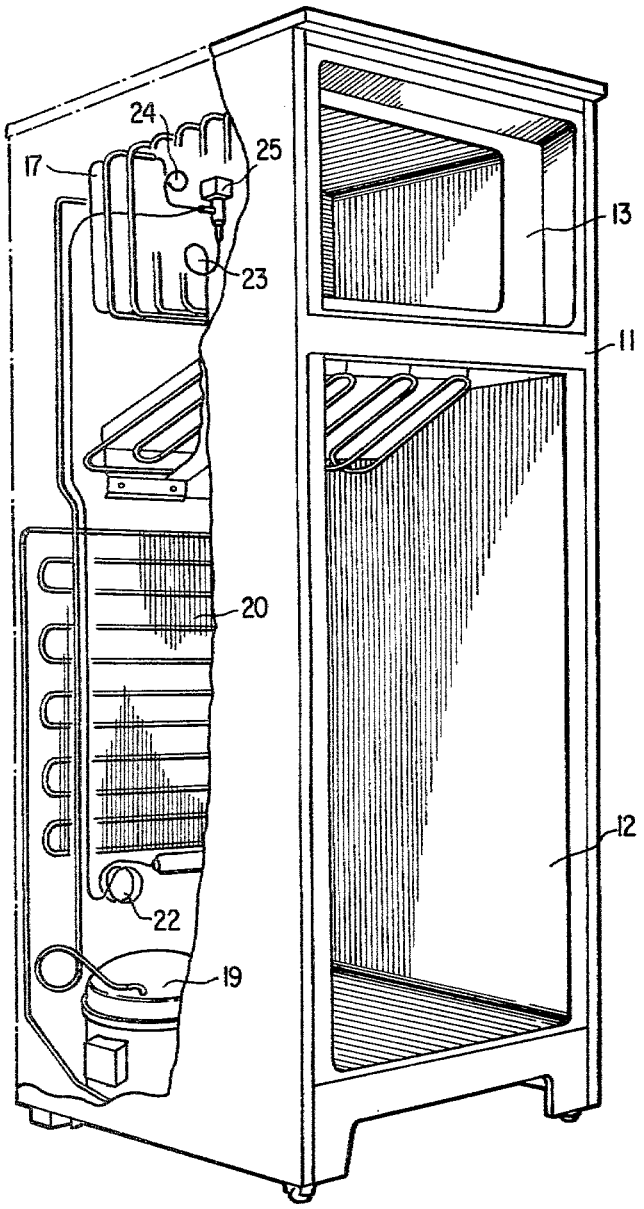
FIG. 2 is a skeletonized view of FIG. 1 in which doors for compartments are removed.

Referring now to the drawings, and more particularly to FIG. 1 and FIG. 3, a refrigerating apparatus generally designated by the reference numeral 10 includes a cabinet 11 having a first compartment such as refrigeratory food compartment 12 and a second compartment such as frozen food compartment 13 therein. Upper and lower doors 14 and 15, respectively, for the first compartment 12 and the second compartment 13, are pivotally secured to one side of the cabinet 11.

These compartments 12 and 13, respectively, include a first evaporator such as refrigeratory evaporator 16 and a second evaporator such as frozen evaporator 17 as a refrigerant circuit 18 therein. Moreover, the second evaporator 17 is formed as a part of the second compartment 13.

The refrigerant circuit 18 includes a compressor 19, a condenser 20, an expansion device 21 and the two evaporators 16 and 17 The expansion device 21 has three capillary tubes 22, 23 and 24 and a valve 25 such as an electromagnetic valve. In the device 21, the first capillary tube 22 is connected between the condenser 20 and an inlet 251 of the valve 25, the second capillary tube 23 is connected between a first outlet 252 of the valve 25 in which the refrigerant gas flows when the valve 25 is opened and an inlet 161 of the first evaporator 16. The third capillary tube 24 is connected between a second outlet 253 of the valve 25 in which the refrigerant gas flows when the valve 25 is closed and an inlet 171 of the second evaporator 17.

Moreover, the conduit resistance of the second capillary tube 23 and the third capillary tube 24 are set by the length and an inside diameter of each capillary tube. For example, the second capillary tube 23 has a length of 0.05 to 0.3 m and an inside diameter of 0.7 mm, and the third capillary tube 24 has a length of 1.5 m and an inside diameter of 0.7 mm.

Accordingly, in the operation of the compressor 19, the refrigerant gas flows to the second evaporator 17 through the first evaporator 16 when the valve 25 is opened. And the refrigerant gas flows directly to the second evaporator 17 without passing through the first evaporator 16 when the valve 25 is closed.

Figure 4:
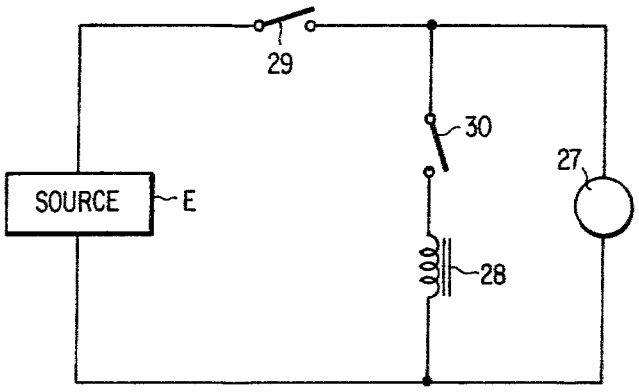
FIG. 4 is a diagram of control circuit according to the present invention.

In FIG. 4, a control circuit 26 for operating the refrigerant circuit 18, includes a motor 27 for driving the compressor 19, a solenoid coil 28 for moving the valve 25 and two temperature sensitive switches 29 and 30, the first temperature sensitive switch 29 being operated by the temperature in the second compartment 13 and the second temperature sensitive switch 30 being operated by the temperature in the first compartment 12.

Therefore, the first switch 29 and the motor 27 are connected in series to source E, and the second switch 30 and the solenoid coil 28 are connected in parallel to the motor 27.

In operation of above described refrigerating apparatus, if the temperatures in the first compartment such as a refrigeratory food compartment 12 and the second compartment 13 such as a frozen food compartment are higher than a predetermined temperature therein, the motor 27 and the solenoid coil 28 are energized when the first switch 29 and the second switch 30 are closed. Thus, the compressor 19 is operated by the motor 27 and the valve 25 is moved to the open position by the solenoid coil 28.

As a result, the refrigerant gas flows to the second evaporator 17 by way of the second capillary tube 23 and the first evaporator 16 from the valve 25, and the first compartment 12 and the second compartment 13 are cooled.

Thereafter, if the temperature in the first compartment 12 is lower than the predetermined temperature, the solenoid coil 28 is deenergized when the second switch 30 is opened and the valve 25 is moved to its closed position. Thus, the refrigerant gas flows to the second evaporator 17 by way of the third capillary tube 24 from the valve 25 and does not flow to the first evaporator 16.

As a result, the valve 25 does not frost, because the valve 25 is connected between the first capillary tube 22 and the second capillary tube 23 or the third capillary tube 24 so that the refrigerant gas does not evaporate in the valve.

After a time, if the temperature has dropped to a desirable value in both compartments, the motor 27 is stopped when the first switch 29 is opened.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a refrigerating apparatus including a cabinet, a refrigerating food compartment and a frozen food compartment in said cabinet, first and second doors movably secured to said cabinet for closing said compartments, first and second evaporators comprising a refrigerant circuit for cooling each of said compartments, an electric solenoid valve for controlling a refrigerant gas flowing to each of said evaporators, and a controlling circuit for operating said refrigerant circuit, wherein said controlling circuit comprises a second temperature-sensitive switch and a solenoid coil connected to said second temperature-sensitive switch for operating said valve, and wherein said refrigerant circuit further comprises:

a motor driven compressor, a condenser connected to said compressor, a first capillary tube connected at one end to said condenser, said valve having one inlet and two outlets and operable in an open position to provide flow between said inlet and a first one of said outlets, and in a closed position to permit flow between said inlet and a second one of said outlets, and said inlet and said valve being connected to the other end of said first capillary tube, a second capillary tube connected at one end to said first one of said outlets of said valve, an inlet of said first evaporator connected to the other end of said second capillary tube for cooling said refrigeratory food compartment, an inlet of said second evaporator connected to an outlet of said first evaporator for cooling said frozen food compartment, and a third capillary tube connected at one end to said second outlet of said valve and at another end to said inlet of said second evaporator, whereby a refrigerant gas flows to said first evaporator when said valve is opened by the temperature in said refrigeratory food compartment.

2. A refrigerating apparatus according to claim 1 wherein said controlling circuit further comprises a first thermal sensitive switch and a motor connected to said first switch for driving said compressor.

3. A refrigerating apparatus according to claim 2 wherein said motor is connected in parallel with said second switch and said solenoid coil.

4. A refrigerating apparatus according to claim 2 wherein said first temperature-sensitive switch is operated by the temperature in said frozen food compartment.

* * * * *